US006070959A

United States Patent [19]

Kanbayashi et al.

[11] Patent Number: 6,070,959

[45] Date of Patent: Jun. 6, 2000

[54] RECORDING METHOD FOR USE IN INK JET TYPE RECORDING DEVICE AND INK JET TYPE RECORDING DEVICE

[75] Inventors: Kenichi Kanbayashi; Toshio Kumagai; Yasuhiko Kosugi, all of Nagano-ken, Japan

[73] Assignee: Seiko Epson Corporation, Tokyo, Japan

[21] Appl. No.: 08/809,493

[22] PCT Filed: Jul. 19, 1996

[86] PCT No.: PCT/JP96/02019

§ 371 Date: May 7, 1997

§ 102(e) Date: May 7, 1997

[87] PCT Pub. No.: WO97/03835

PCT Pub. Date: Feb. 6, 1997

[51] Int. Cl.[7] ..... B41J 29/38

[52] U.S. Cl. ..... 347/11

[58] Field of Search ..... 347/11, 70, 10, 347/717, 33, 68, 69

[56] References Cited

U.S. PATENT DOCUMENTS

| | | | |
|---|---|---|---|
| 5,541,628 | 7/1996 | Chang et al. | 347/11 |

FOREIGN PATENT DOCUMENTS

| | | | |
|---|---|---|---|
| 355065568 | 5/1980 | Japan | 347/11 |
| 63-247049 | 10/1988 | Japan | B41J 3/04 |
| 401026454 | 1/1989 | Japan | 347/11 |
| 3-164261 | 7/1991 | Japan | B41J 2/165 |
| 7-137252 | 5/1995 | Japan | B41J 2/045 |
| 7-148934 | 6/1995 | Japan | B41J 2/165 |
| 9030007 | 2/1997 | Japan | B41J 2/175 |

*Primary Examiner*—John Barlow
*Assistant Examiner*—Charles W. Stewart, Jr.
*Attorney, Agent, or Firm*—Sughrue, Mion, Zinn, Macpeak & Seas, PLLC

[57] ABSTRACT

The recording device of an ink jet type comprises a drive voltage generation circuit which, in synchronization with a timing signal given from outside, generates a first drive voltage having a trapezoidal wave form, a drive circuit which outputs a first drive voltage to a piezo-vibrator in accordance with a printing signal given from outside and also, in synchronization with the timing signal, outputs a second drive voltage, which is used to generate such a small pulse that cannot jet out ink drops from a nozzle opening, to the piezo-vibrator in which a non-printing condition has continued for one or more cycles, and control means which stops the application of the small pulse when the time of application of the small pulse after completion of a printing operation exceeds a given time. When the ink drops have not been jetted out for one or more cycles, the small pulse is applied to thereby vibrate menisci in the neighborhood of the nozzle opening, in order to prevent the nozzle opening from being clogged up without causing any ink mist. At the same time, at the time when the printing operation is interrupted and the application of the small pulse continues for a given time or longer, the application of the small pulse is stopped to thereby prevent an unnecessary increase in the viscosity of the ink in the nozzle opening which can occur due to the slight vibrations of the menisci.

36 Claims, 10 Drawing Sheets

(n - 1)-TH PRINTING CYCLE
n-TH PRINTING CYCLE
PRINT DATA OF n-TH PRINTING CYCLE
PRINT DATA OF n-TH PRINTING CYCLE
VH
VH
VS
tn - 1
tn
B
A

TIMING SIGNAL

SHIFT CLOCK

PRINT DATA

LATCH SIGNAL

DRIVE SIGNAL

VOLTAGE IN PRINTING

SMALL PULSE

SELECT SIGNAL

RECORDING METHOD FOR USE IN INK JET TYPE RECORDING DEVICE AND INK JET TYPE RECORDING DEVICE

FIELD OF THE INVENTION

The present invention relates to a technology for preventing the clogging-up of a nozzle opening in a recording device of an ink jet type using an ink jet recording head of an on-demand type.

BACKGROUND OF THE INVENTION

An ink jet recording head of an on-demand type includes a plurality of nozzle openings and pressure generation chambers in communication with the respective nozzle openings and is structured such that the pressure generation chambers can be expanded and contracted in accordance with a printing signal to thereby generate ink drops.

By the way, when attached to a recording medium such as paper, the ink drops can blur on the paper depending on the quality of the paper or can be contacted with some other member to thereby cause a rub between them and, therefore, the ink is prepared in such a manner that the solvent thereof can be volatilized and solidified as rapidly as possible. Due to this, when a printing operation is interrupted, the ink solvent in the nozzle opening is volatilized rapidly to thereby cause the nozzle opening to be clogged up. In view of this, there are taken measures to install caps on the nozzle openings to thereby prevent the volatilization of the ink solvent.

On the other hand, during the printing operation, since new ink is supplied to the nozzle openings, the nozzle openings are more difficult to be clogged up. However, some of the nozzle openings, for example, nozzle openings which are situated in the upper and lower end portions of the recording head, have few chances to jet out the ink drops and, therefore, they can be clogged up easily.

In order to solve this problem, there is proposed a so called flushing operation in which, at a stage when the printing operation has been continued for a given period of time, the recording head is made to retreat into capping means which is disposed in a non-printing area, a drive signal is applied to piezo-vibrators to thereby jet out the ink drops from all nozzle openings forcibly toward their respective caps. This flushing operation can truly solve the nozzle opening clogging-up problem but it is necessary that the printing operation is interrupted and the recording head is moved to the capping means, which lowers the printing speed extremely.

In order to reduce the frequency of such flushing operation as much as possible, there are proposed a large number of technologies (for example, Japanese Patent Publication No. Sho. 55-123476, Japanese Patent Publication No. Sho. 57-61576, U.S. Pat. No. 4,350,989) in which, during the printing operation, a minute drive signal incapable of jetting out the ink drops is applied to the piezo-vibrators respectively provided in a pressure generation chamber in communication with the nozzle openings to thereby vibrate menisci disposed adjacent to the nozzle openings, in order to prevent the nozzle openings from being clogging up.

According to these technologies, there is eliminated the need to move the recording head to the capping position that is necessary for the flushing operation, thereby preventing the lowering of the printing speed. However, in a recording head using ink which is hard to blur on the recording medium, such as ink which contains therein resin emulsion to thereby be able to promote the quick formation of membrane, if the menisci are unnecessarily caused to vibrate slightly, then the ink solvent existing in the neighborhood of the menisci becomes easy to volatilize, which not only increases the viscosity of the ink but also promotes the membrane formation, thereby causing the nozzle openings to be clogged up.

In order to solve such problem, as disclosed in U.S. Pat. No. 5,329,293, there is proposed a printer of an ink jet type in which, after ink drops for printing are jetted out, the menisci are slightly vibrated at given intervals, thereby being able to prevent an increase in the viscosity of the ink which is caused by the unnecessary slight vibrations of the menisci.

However, in the actual printing, there has not been proposed yet a technology which is sure to prevent the nozzle openings from being clogged up until a series of operations have been finished; that is, in the series of operations, there are included an operation to put the power supply into work, an operation to remove the recording head from the caps, an operation to carry out a predetermined printing operation, and an operation to seal off the recording head again after completion of a printing operation.

SUMMARY OF THE INVENTION

It is a first object of the invention to provide a recording method for use in a recording device of an ink jet type, which is sure to prevent the nozzle openings from being clogged up during a period extending from the start of the power supply to the stop of the power supply.

Also, it is a second object of the invention to provide a recording device of an ink jet type which is suitable for the above-mentioned recording method.

Further, it is a third object of the invention to provide a printing method for use in a recording device of an ink jet type, which not only can prevent the ink membrane formation and an increase in the viscosity of the ink as much as possible but also can cause the menisci to vibrate slightly.

Still further, it is a fourth object of the invention to provide a device which is suitable for the above-mentioned printing method.

According to the invention, there is provided a printing method for use in a recording device of an ink jet type comprising: a recording head of an ink jet type including a nozzle plate having a plurality of nozzle openings capable of jetting out ink drops for forming dots on a recording medium for printing, a pressure chamber formed in communication with the nozzle openings, and pressure generation means for applying pressure to the pressure chamber; a carriage for moving the recording head of an ink jet type reciprocatingly in the width direction of the recording medium; capping means disposed out of a printing area for sealing off the recording head; cleaning means disposed out of the printing area and capable of moving relative to the nozzle plate in contact with the surface of the nozzle plate to thereby solve the clogged-up condition of the nozzle openings; and, drive signal generation means for supplying to the pressure generation means a drive signal which causes pressure variations in the pressure generation chamber, the printing method is characterized in that, in accordance with a drive signal for forming dots for printing, there is supplied to the pressure generation means a small pulse which causes menisci formed in the nozzle openings to be vibrated in such a degree that the ink drops are not jetted out.

According to the present printing method, during the printing operation, a small pulse is selectively applied to one or more nozzle openings from which the ink drops have not been jetted out for one or more cycles, thereby vibrating the menisci in order to prevent the nozzle openings from being clogged up without generating the ink mist. At the same time, when the printing operation is interrupted and the small pulse application period continues for a given time or more, the application of the small pulse is stopped to thereby prevent the viscosity of the ink in the associated nozzle opening from being increased unnecessarily.

DETAILED DESCRIPTION OF THE PREFERRED EMBODIMENT

Now, description will be given below in detail of the invention with reference to an embodiment shown in the accompanying drawings.

Figure 1:
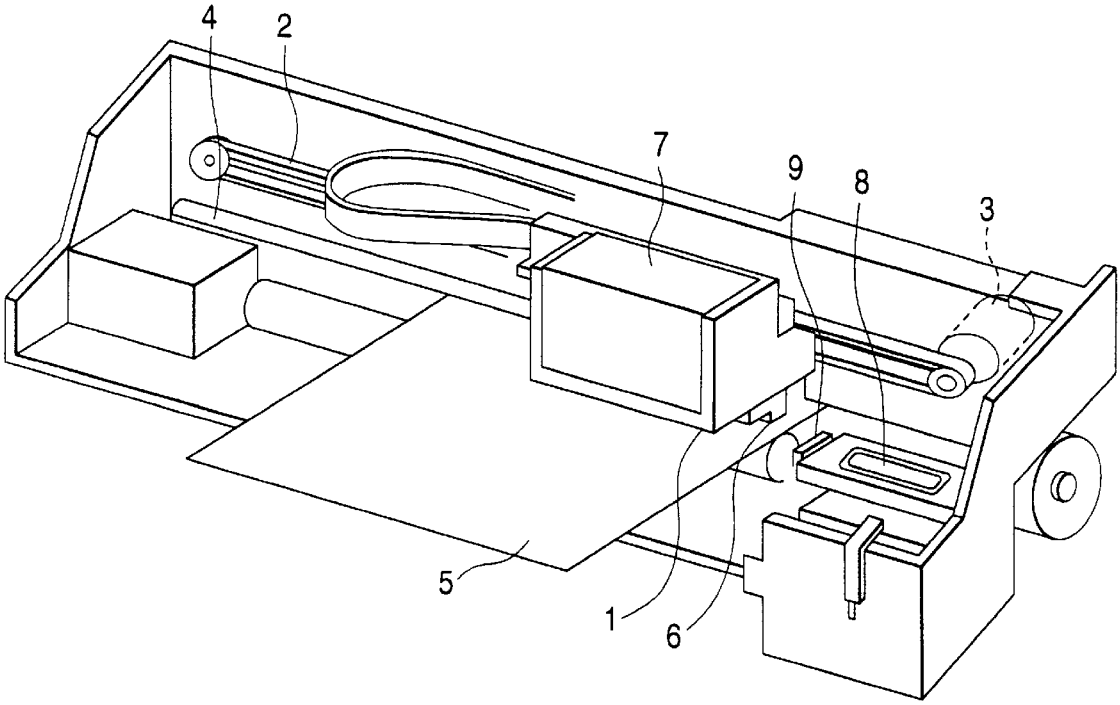
FIG. 1 is a perspective view of an embodiment of a recording device of an ink jet type to which the invention is applied.

FIG. 1 shows an embodiment of a structure according to the invention and, in particular, the structure of the printing mechanism and its peripheral devices of a printer according to the invention. In FIG. 1, reference character 1 designates a carriage which is connected through a timing belt 2 to a pulse motor 3 and is structured such that it can be moved reciprocally in the width direction of recording paper 5 while being guided by a guide member 4.

On the surface of the carriage 1 that is opposed to the recording paper 5, in particular, in the present embodiment, on the bottom surface of the carriage 1, there is mounted a recording head 6 of an ink jet type which will be discussed later. While ink is supplied thereto from an ink cartridge 7 placed on the top portion of the carriage 1, the ink jet type recording head 6 jets out ink drops onto the recording paper according to the movement of the carriage 1 to thereby form dots thereon, so that images and characters can be printed on the recording paper.

Reference character 8 stands for a capping device which is disposed in a non-printing area and is structured such that, during the printing-stop period of the printer, seals off the nozzle openings of the recording head 6, whereas it receives the ink drops from the recording head 6 due to the flushing operation to be performed during the printing operation. 9 designates cleaning means which is disposed in the neighborhood of the capping device 8 existing in the non-printing area. The cleaning means 9 is structured such that it wipes ink dregs or paper powder off the surface of the nozzle plate and solves the clogged-up condition of the nozzle opening 11, which is disabled to jet out the ink drops, to thereby recover the ink drop jet-out ability thereof.

Figure 2:
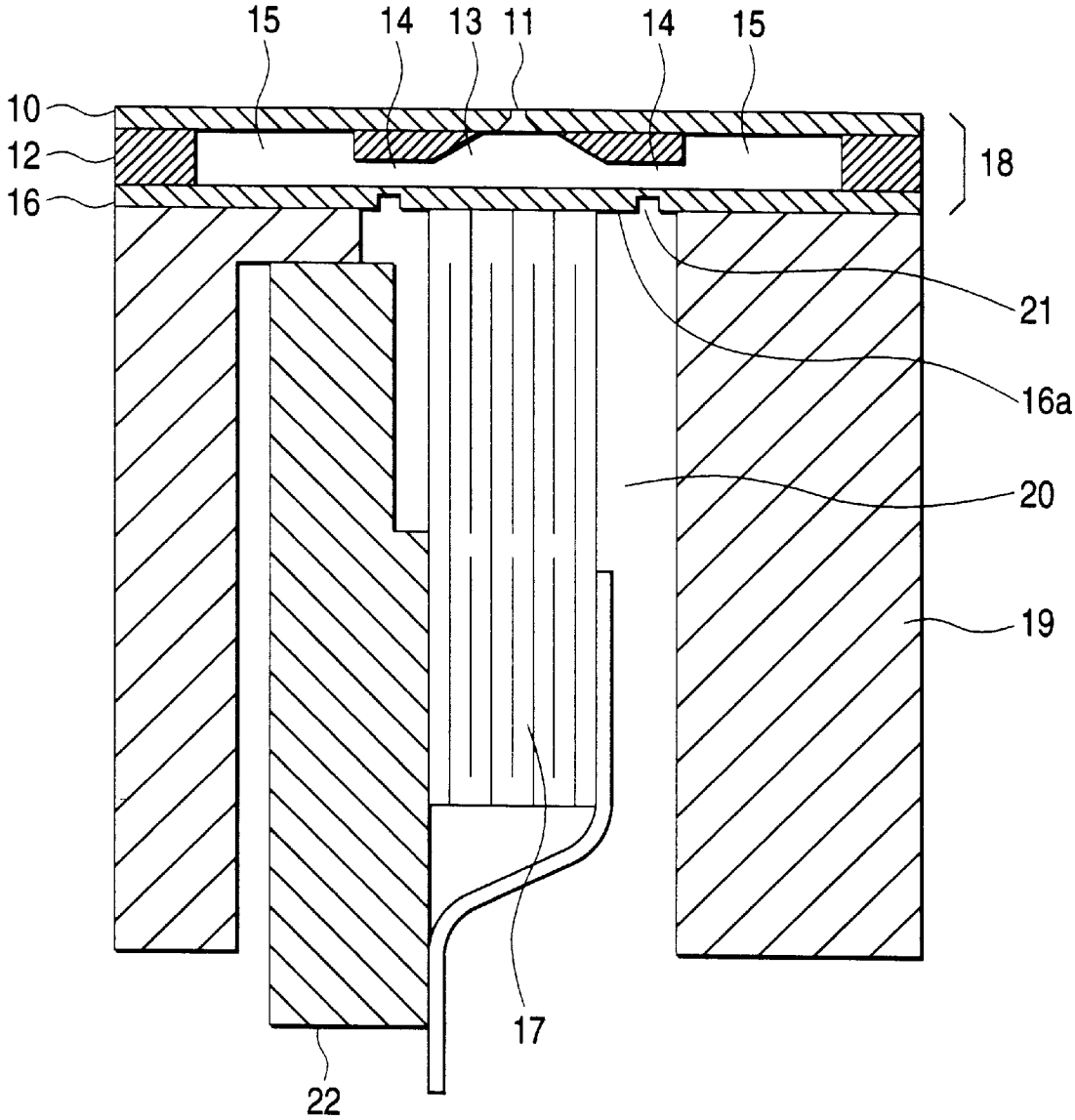
FIG. 2 is a section view of an embodiment of a recording head of an ink jet type for use in the above recording device.

Referring now to FIG. 2, an embodiment of the above-mentioned recording head of an ink jet type is shown by means of the sectional structure of a pressure generation chamber. In FIG. 2, reference character 10 designates a nozzle plate in which there is opened up a nozzle opening 11. Also, 12 stands for a flow path forming plate which includes a through hole for separating a pressure generation chamber 13, a through hole or a groove for separating two ink supply ports 14 and 14 respectively in communication with the two sides of the pressure generation chamber 13, and a through hole for separating two common ink chambers 15 and 15 respectively in communication with the two ink supply ports 14 and 14. Further, 16 designates a vibration plate which is formed of a thin plate elastically deformable when it is contacted with the leading end portion of a piezo-vibrator 17 and also which is liquid-tight and integrally fixed to the nozzle plate 10 with the flow path forming plate 12 between them to thereby form a flow path unit 18. Still further, 19 stands for a base member which includes a storage chamber 20 for storing therein the piezo-vibrator 17 in a vibratable manner and an opening 21 for supporting the flow path unit 18. The base member 19 not only exposes the leading end portion of the piezo-vibrator 17 from the opening 21 and fixes the same by means of a fixing base plate 22, but also brings the island portion 16*a* of the vibration plate 16 into contact with the piezo-vibrator 17 to thereby fix the flow path unit 18 to the opening 21, with the result that the present recording head is assembled.

According to the above-mentioned structure, if the piezo-vibrator 17 is contracted and the pressure generation chamber 13 is expanded, then ink in the common ink chambers 15 and 15 flows into the pressure generation chamber 13 through the ink supply ports 14 and 14. After the passage of a given time, if the piezo-vibrator 17 is extended and the pressure generation chamber 13 is contracted, then the ink of the pressure generation chamber 13 is compressed and the ink drops are jetted out from the nozzle opening 11, thereby forming dots on the recording paper. Then, if a small pulse of such a level that cannot jet out the ink drops is applied to the piezo-vibrator 17 to thereby cause the piezo-vibrator 17 to be contracted a slight amount, then the pressure generation chamber 13 is also expanded a little, so that menisci in the neighborhood of the nozzle opening 11 are drawn in toward the pressure generation chamber 13 side; and, next, if the piezo-vibrator 17 is returned to its original condition, then the pressure generation chamber is contracted so that the menisci are slightly pushed back to the nozzle opening 11 side.

By applying the small pulse to the piezo-vibrator 17 periodically according to a printing timing in this manner, the menisci in the neighborhood of the nozzle opening are vibrated with a slight amplitude to promote the replacement between the ink in the neighborhood of the nozzle opening and the ink of the pressure generation chamber 13, thereby being able to prevent the nozzle opening from being clogged up.

Figure 3:
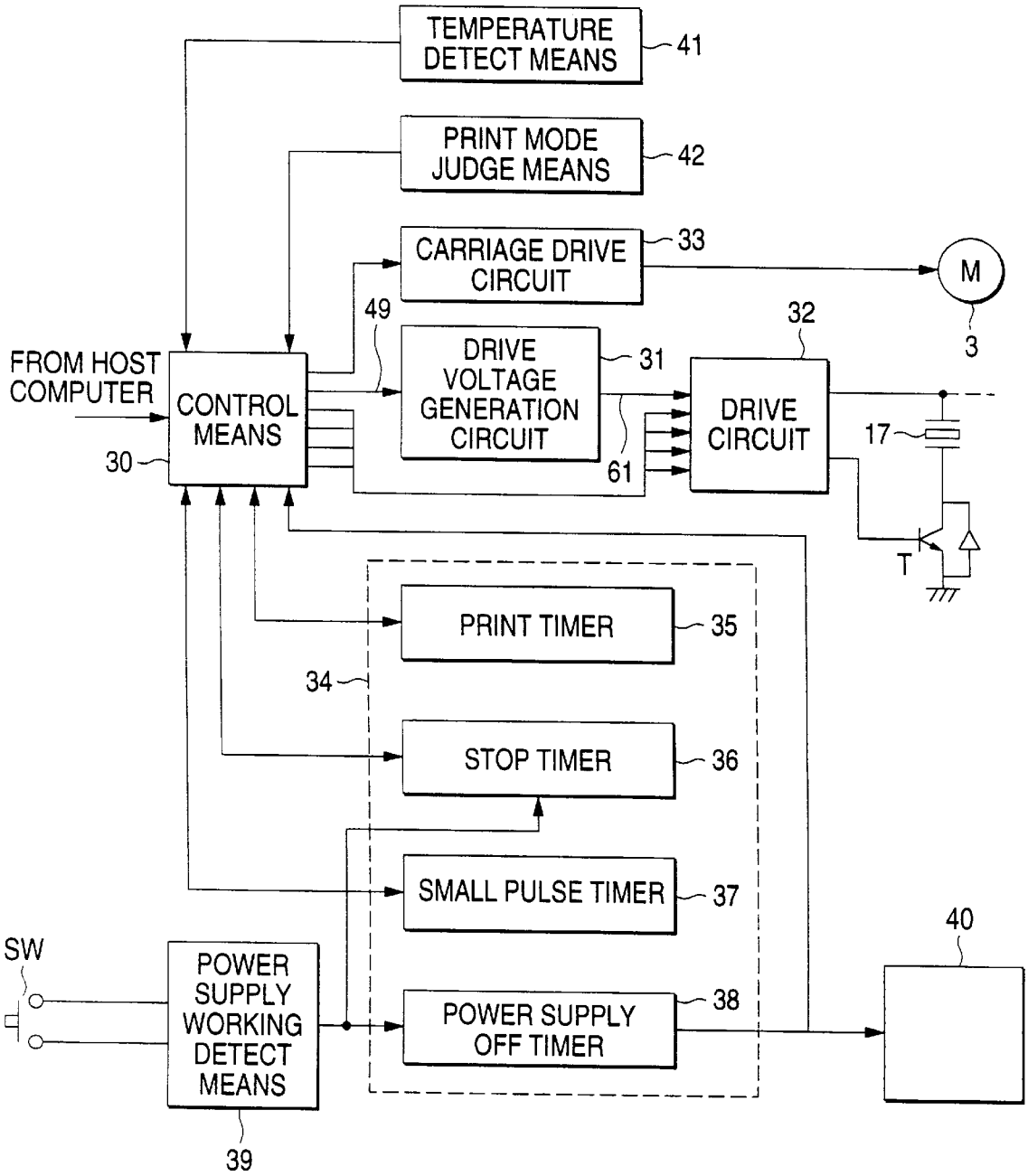
FIG. 3 is a block diagram of the whole of the recording device according to the embodiment of the invention.

Now, FIG. 3 shows an embodiment of a control unit which is used to drive the above-mentioned recording head. In FIG. 3, reference character 30 designates control means which, in accordance with a printing instruction signal and print data from a host computer, controls a drive voltage generation circuit 31, a drive circuit 32 and a carriage drive circuit 33 (all of which will be described later) to thereby execute a printing operation, controls the flushing operation and the application of the small pulse in accordance with the timing data of timer means 34 (which will be described later), and controls a cleaning operation to clean the recording head 6.

Also, the control means 30 is structured such that, in accordance with the temperature of the recording head 6 detected by temperature detect means 41, it controls the number of ink drops to be jetted out in the flushing operation, controls the amplitude of the small pulse, and controls the pressing force of an elastic plate for use in the cleaning operation, the number of times the elastic plate rubs against the recording head, and the like.

Further, the control means 30 controls the number of ink drops to be jetted out in the flushing operation in accordance with the print resolution of the recording head 6 detected by print mode judge means 42. That is, in the flushing operation, since the ink drops are jetted out using a drive signal which allows the ink drops to be jetted out in the printing operation, when the printing operation is executed in a high resolution mode, the ink amounts of the ink drops are so controlled as to reduce the areas of dots to be formed on the recording medium. Therefore, when the resolution is high, in order to increase the number of the ink drops in the flushing operation to thereby recover the ink jet-out ability of the nozzle opening, it is necessary to secure the amount of ink to be jetted out.

The drive voltage generation circuit 31 is structured such that it generates a first trapezoidal wave having a voltage value necessary for the nozzle opening 11 to jet out the ink drops for printing or for flushing. On the other hand, the drive circuit 32 is structured such that it selectively applies the drive voltage of the drive voltage generation circuit 31 to the piezo-vibrator(s) 17 corresponding to the print data, and applies the drive voltage of the drive voltage generation circuit 31 as a small pulse to the piezo-vibrator 17 that has not jetted out the ink drops for at least one cycle.

Now, 35 designates a print timer which is used to count the continuous time of the printing operation. That is, the print timer 35 is started at the time of the start of the printing operation, interrupts its time counting operation at the end of the printing operation, and is set when the flushing operation or cleaning operation is executed. 36 stands for a stop timer which, in a state in which the power is being supplied to the recording device, counts the time during which the printing operation is stopped. The stop timer 36 is set at the time when the printing operation is started, and starts to count the time when the printing operation is interrupted. Also, 37 designates a small pulse timer which starts to count the time when there is applied a small pulse to vibrate slightly menisci in the neighborhood of the nozzle opening 11, and is reset when the application of the small pulse is stopped.

Further, 38 stands for a power supply off timer which is started at the time when it is detected by power supply working detect means 39 that a box-shaped power supply switch SW is turned off. That is, the power supply off timer 38, after the passage of the time necessary for the capping device 8 to seal off the recording head 6, outputs a signal to de-energize a relay 40 to thereby interrupt the supply of the main power to the recording device, and counts the time during which the power is not supplied to the recording device.

Figure 4:
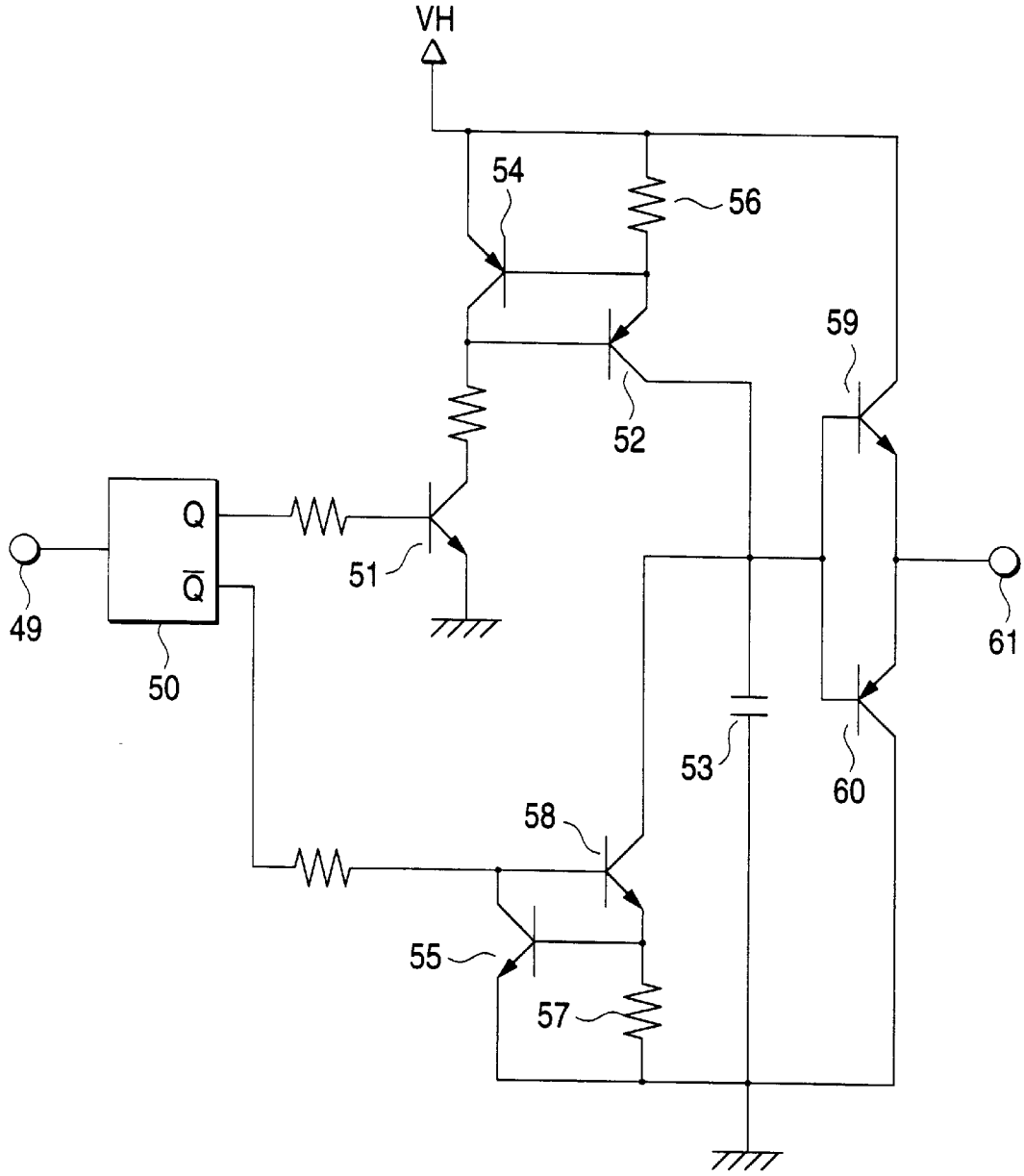
FIG. 4 is a circuit diagram of an embodiment of a drive voltage generation circuit employed in the above recording device.

FIG. 4 shows an embodiment of the above-mentioned drive voltage generation circuit 31 and, in FIG. 4, reference character 50 designates a one-shot mulitivibrator which converts a timing signal given by an external device to a pulse signal having a given width, and outputs positive and negative signals from the output terminal thereof in synchronization with the timing signal. To one terminal of the one-shot mulitivibrator 50, there is connected the base of an NPN type transistor 51 to which is connected a PNP type transistor 52. The PNP type transistor 52, at the time when the timing signal is input, charges a capacitor 53 at a constant current $I_r$ until the capacitor 53 reaches substantially a voltage $V_H$.

To the other terminal of the one-shot multivibrator 50, there is connected an NPN transistor 58. At the time when the timing signal is switched, the transistor 52 is turned off and the transistor 58 is turned on to thereby cause the capacitor 53 to discharge the electric charges stored therein at a constant current. If until they are reduced down substantially to a voltage of zero volts.

In other words, if the base-emitter voltage of a transistor 54 is expressed as $V_{BE54}$ and the resistance value of a resistor 56 is expressed as $R_r$, then a charge current $I_r$ can be obtained in the following manner: $I_r=V_{BE54}/R_r$. Also, if the capacity of the capacitor 53 is expressed as $C_O$, then the rising time $T_r$ of the charge voltage can be obtained in the following manner:

$$T_r \approx C_O \times V_H / I_r.$$

On the other hand, if the base-emitter voltage of a transistor 55 is expressed as $V_{BE55}$ and the resistance value of a resistor 57 is expressed as $R_f$, then the discharge current $I_f$ of the drive signal can be obtained in the following manner: $I_f=V_{BE55}/R_r$. Also, the falling time can be obtained in the following manner:

$$T_f \approx C_O \times V_H / I_f.$$

Figure 6:
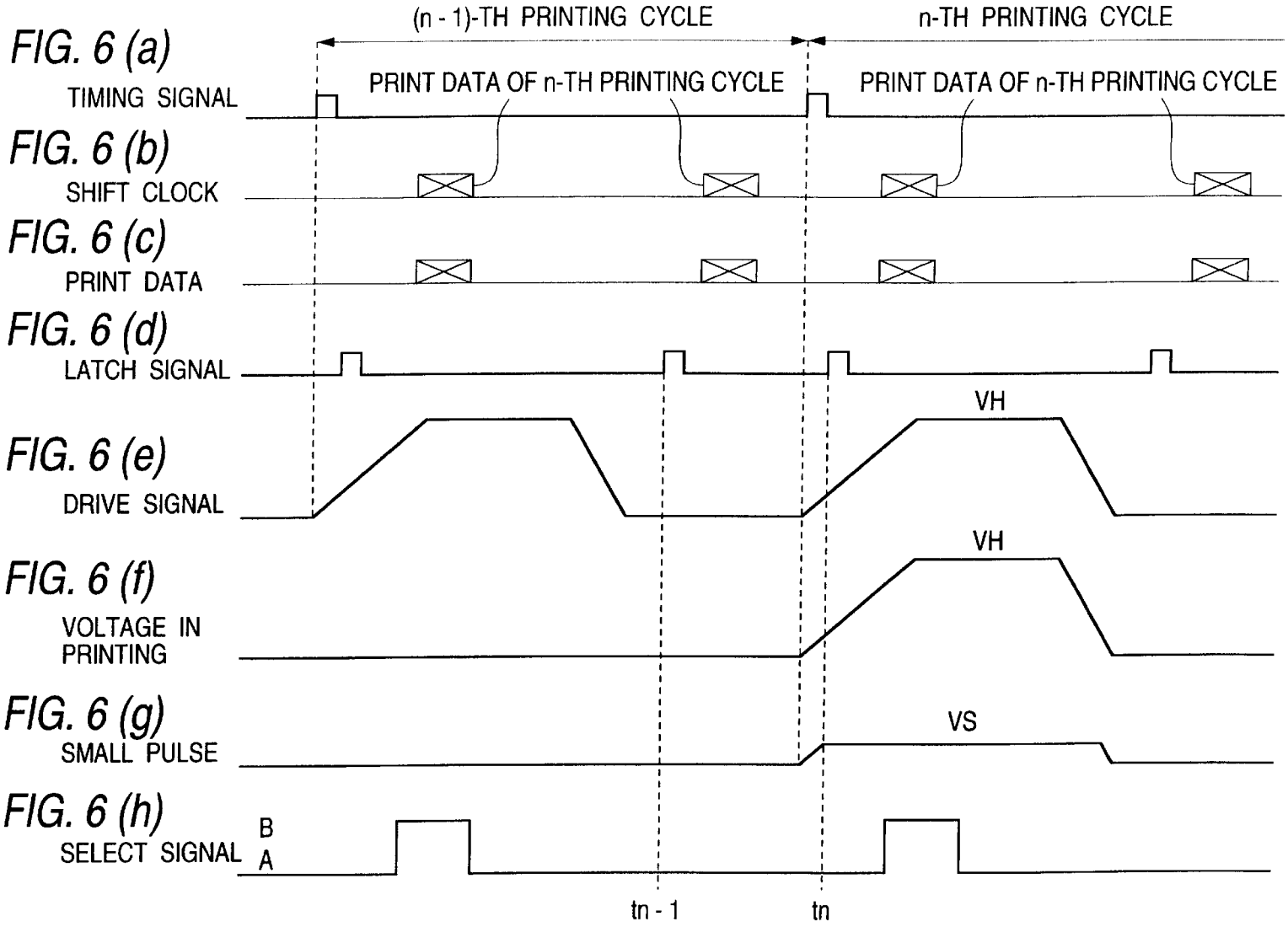
FIGS. 6(*a*) to 6(*h*) are respectively wave form charts of the operations of the above recording device.

As a result of this, the terminal voltage of the capacitor 53, as shown in FIG. 6(*e*), varies as a trapezoidal wave form which includes an area rising at a constant gradient, a saturation area keeping a constant value, and an area falling at a constant gradient.

The present terminal voltage of the capacitor 53 is current amplified by transistors 59 and 60 and, after then, it is output as a drive signal from a terminal 61 to the respective piezo-vibrators 17, 17, 17, . . . .

Next, description will be given below of the operation of the above-mentioned drive voltage generation circuit 31.

When a timing signal is input thereto from the control means 30, the drive voltage generation circuit 31 turns on and off the transistors 52 and 58 to thereby output a drive signal having a trapezoidal voltage wave form. On the other hand, since switching transistors T, T, T, . . . respectively connected to the piezo-vibrators 17 to be printed are turned on by a drive circuit 32 (which will be described later), the piezo-vibrators 17 are electrically charged by the drive signal until they reach the voltage $V_H$.

As a result of this, a voltage signal generated in the drive voltage generation circuit 31 is applied to the piezo-vibrators 17 so that the piezo-vibrators 17 are charged at a constant current. Due to this charging operation, the piezo-vibrators 17, 17, 17, . . . to jet out the ink drops for printing are contracted and the pressure generation chamber is expanded. This condition is maintained for a given time.

When the given time has passed, the transistor 58 turns on and a capacitor 53 is discharged and, for this reason, the piezo-vibrators 17, 17, 17, . . . are also discharged and extended, while the pressure generation chamber 13 is contracted, so that the ink drops are jetted out from the nozzle openings 11.

On the other hand, if the print data have not been input for one or more cycles, then only the switching transistors T, T, T, . . . , into which the print data have not been input, are turned on in accordance with a signal from the drive circuit 32 to be described later. As a result of this, the piezo-vibrators 17, 17, 17 are charged by means of a voltage from the drive voltage generation circuit 31. However, since a pulse signal falls down during the rising process of the voltage due to such charging, the switching transistors T, T, T, . . . are caused to turn off, so that the charging with respect to these piezo-vibrators 17, 17, 17, . . . , is terminated at the voltage $V_S$ that has been obtained up to the then time.

In this manner, while the piezo-vibrators are charged at the voltage $V_S$, if the transistor 58 turns on after the passage of a given time to thereby discharge the charges of the piezo-vibrators 17, 17, 17, . . . , then the piezo-vibrators 17 are extended by an amount proportional to the charged voltage $V_S$.

As a result of this, as shown in FIG. 6(*g*), the piezo-vibrators 17 are extended by an amount of displacement smaller than that during printing, thereby being unable to jet out the ink drops from the nozzle opening 11. That is, the pressure generation chamber 13 is expanded and contracted slightly to thereby induce slight vibrations in the menisci in the neighborhood of the nozzle opening 11. Such slight vibrations of the menisci replace the ink in the neighborhood of the nozzle opening 11 left in a non-printing condition with the ink of the pressure generation chamber 13 having a relatively lower viscosity to thereby lower the viscosity of the ink of the nozzle opening 11, so that the time necessary for the nozzle opening 11 to be clogged up can be extended.

After then, the piezo-vibrator 17, which belongs to the nozzle opening 11 to form dots according to the timing signal, is charged and discharged at such a voltage that permits generation of the ink drops, whereas the piezo-vibrator 17 into which the print data have not been input for one or more cycles is charged and discharged at a low voltage $V_S$ insufficient to jet out the ink drops, thereby vibrating the menisci of the nozzle opening 11 slightly.

Figure 5:
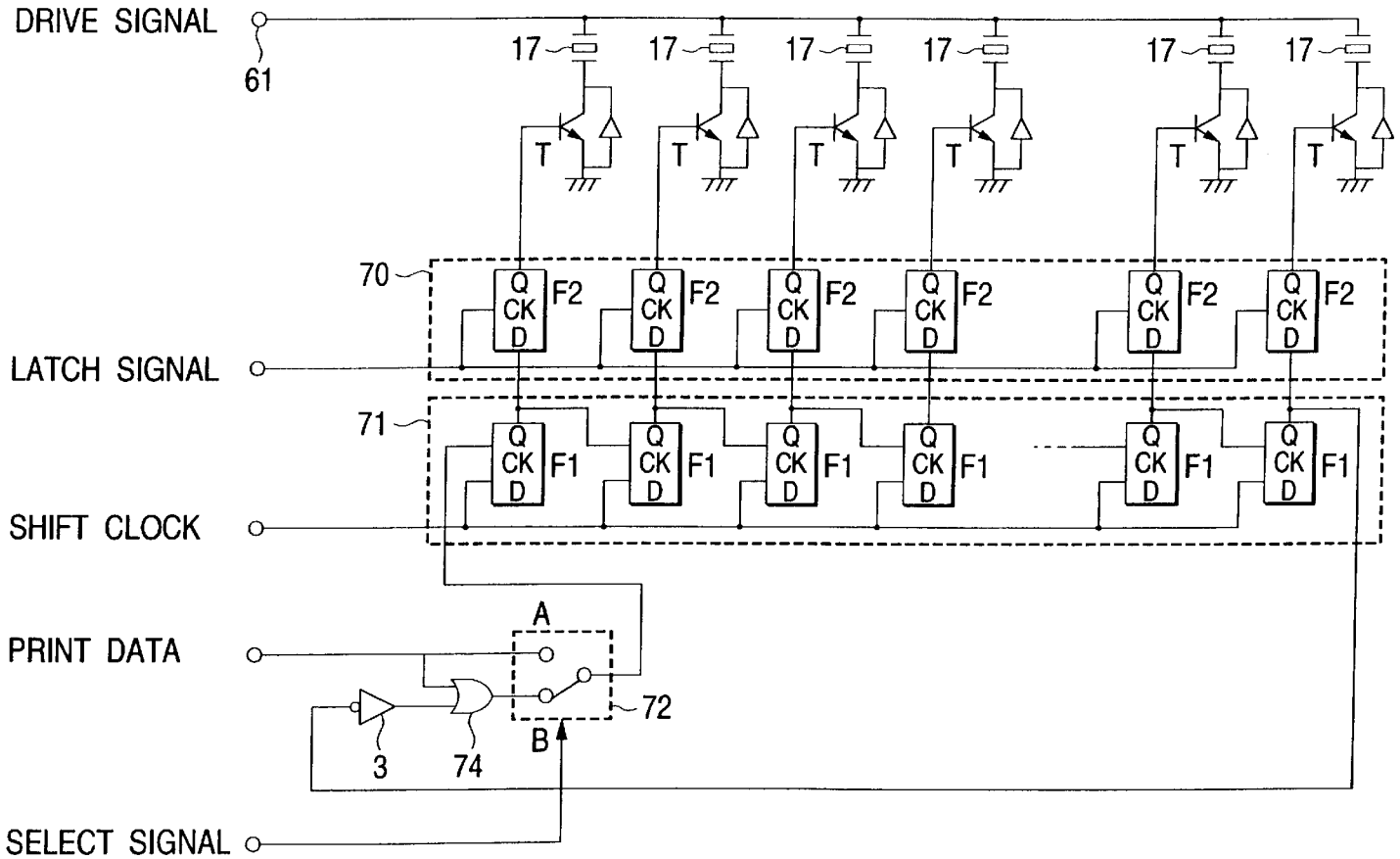
FIG. 5 is a circuit diagram of an embodiment of the above drive voltage generation circuit.

Now, FIG. 5 shows an embodiment of the above-mentioned drive circuit 32 and, in FIG. 5, reference character 71 designates a shift register which is connected with its slave flipflops F1, F1, F1, . . . and transfers the print data sequentially according to shift clocks.

70 stands for a latch circuit which is connected with its slave flipflops F2, F2, F2, . . . , latches a signal from the shift register 71 by means of a latch signal, and outputs a select signal to switching transistors T, T, T, . . . which are respectively connected with the piezo-vibrators 17, 17, 17, . . . .

72 designates switching means which includes two input terminals A and B. In the switching means 72, the print data are input to the terminal A and, on the other hand, to the terminal B, there are input through an Or gate 74 not only the print data to be printed at the next timing but also inverted signals obtained by inverting the print data to be printed at the current printing operation output from the shift register 71 by an inverter 73. Also, the switching means 72 can select a data input for printing or application of a small pulse in accordance with a select signal from the control means 30.

Next, description will be given below of the operation of the drive circuit 32 with reference to a timing chart shown in FIGS. 6(*a*) to 6(*h*).

At the (n−1)-th printing cycle just before a printing target cycle (the n-th printing cycle), the terminal B of the switching means 72 is selected according to the select signal, and the printing target data of all of the nozzle openings are input to the shift register 71 in synchronization with the shift clocks.

Then, at the time tn−1 when the trapezoidal drive voltage signal output in synchronization with a timing signal generated each time the recording head 6 is moved a given distance reaches the ground level, the drive circuit 32 outputs a latch signal, the data that are stored in the shift register 71 are latched all together by the latch circuit 70, and the switching transistors T, T, T, . . . are respectively controlled to turn on and off.

That is, only the switching transistor(s) T, which correspond(s) to the nozzle opening(s) that jet(s) out the ink drops at the just previous printing cycle ((n−1)-th printing cycle) but do(es) not jet out the ink drops at the next printing cycle (n-th printing cycle), is (are) turned off selectively, and the transistors T corresponding to the other nozzle openings are turned on; and, after then, until the time $t_n$ when the latch signal is input to the latch circuit 70, the above condition is maintained, and, through the switching transistors T which are on at the n-th printing cycle of the printing target, the corresponding piezo-vibrators 17, 17, . . . are charged up to the slight voltage $V_S$.

After the data are latched at the time tn−1, the terminal A of the switching means 72 is selected in accordance with a select signal, the printing target data are output to the shift register 71 in synchronization with the shift clock similarly to the above-mentioned case, and only the print target data are latched by the latch circuit 70 at the time $t_n$.

After then, if the print data are the data that allow the ink drops to be jetted out, then the piezo-vibrators 17, 17, . . . are continuously charged up to the voltage $V_H$. On the other hand, in the piezo-vibrators 17, 17, . . . which receive the data that prevent the ink drops from being jetted out, the charging thereof is stopped at the time when they are charged up to the voltage $V_S$, and, after then, the voltage $V_S$ is maintained.

After then, since the drive voltage signal falls down suddenly, the piezo-vibrators 17, 17, . . . charged up to the voltage $V_H$ are discharged suddenly to thereby contract the pressure generation chamber 13, so that the ink drops can be jetted out from the nozzle opening 11. Also, because the piezo-vibrators 17, 17, . . . charged up to the voltage $V_S$ are discharged at a slight voltage $V_S$, they are not able to jet out the ink drops but are only allowed to vibrate the menisci in the neighborhood of the nozzle opening 11.

Figure 10:
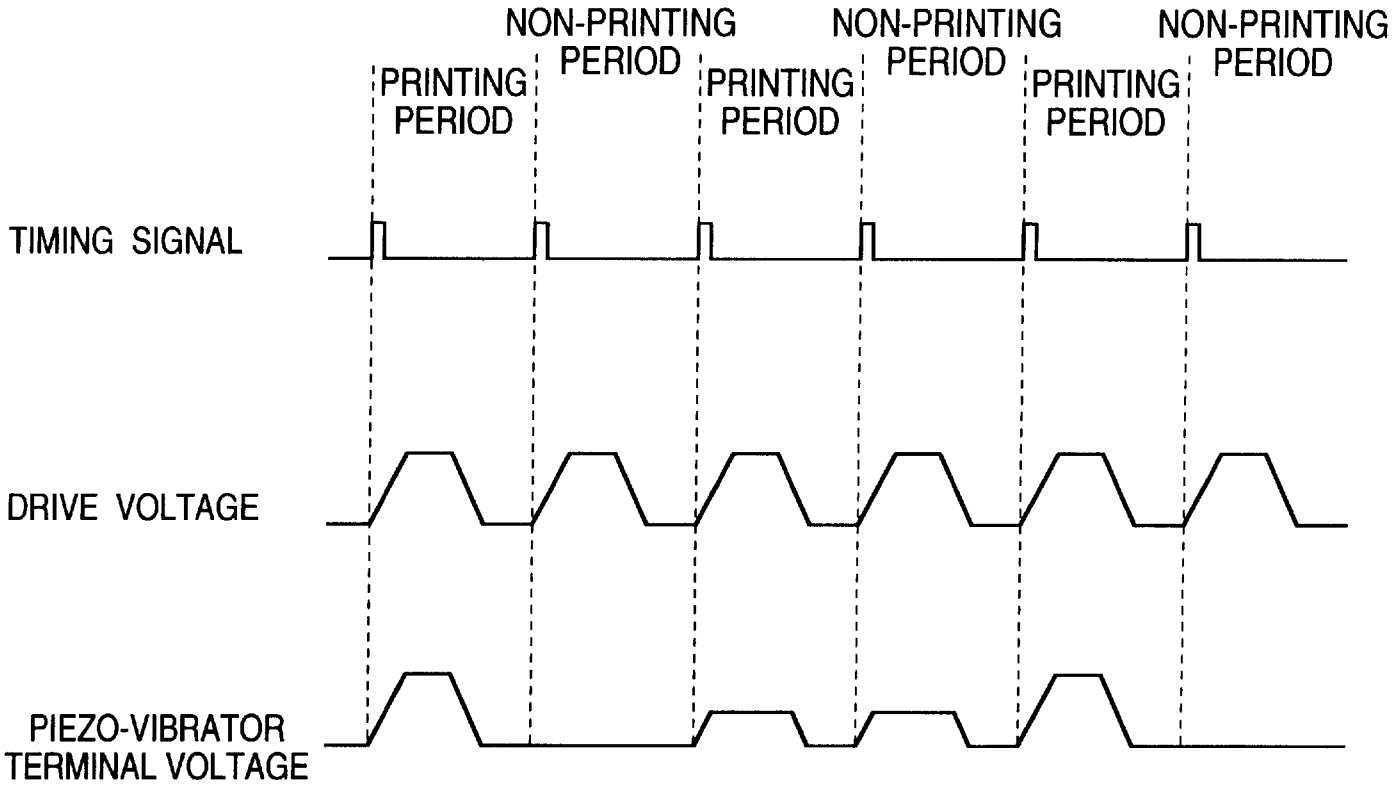
FIGS. 10(*a*) to 10(*c*) are respectively wave form charts of voltages respectively applied to piezo-vibrators during the printing operation and during the stop period.

According to the thus structured drive circuit 32, as shown in FIGS. 10(*a*) to 10(*c*), after the ink drops are jetted out, the small pulse (FIG. 6(*g*)) is applied after a stop period consisting of at least one cycle. Therefore, even if the ink drops for printing are jetted out and the menisci are vibrated greatly after the jetting-out of the ink drops, the vibrations of the menisci are dampened during the stop period. Due to this, even if the menisci are continuously caused to vibrate slightly in accordance with the small pulse, the menisci cannot be vibrated at such a great amplitude that can jet out the ink drops or can cause the nozzle plate to get wet.

Here, the above-mentioned small pulse may be preferably applied even when the ink drops are not jetted out from the recording head 6, for example, when the supply of the print data is stopped, or when the recording paper is being delivered in the printing process, as will be described later. In this case, the application of the small pulse can be realized by outputting as the print data the data that do not jet out the ink drops, such as null data to the drive circuit 32 regardless of the printing signal but according to only the timing signal. In this manner, even in a state in which the ink drops for printing are not jetted out, the application of the small pulse can prevent the nozzle opening 11 from being clogged up.

Next, description will be given below of the entire operation of the recording device, which extends from the start of the supply of the power to the thus structured recording device and to the stop of the supply of the power to the device, with reference to flow charts respectively shown in FIGS. 7 to 9.

Figure 7:
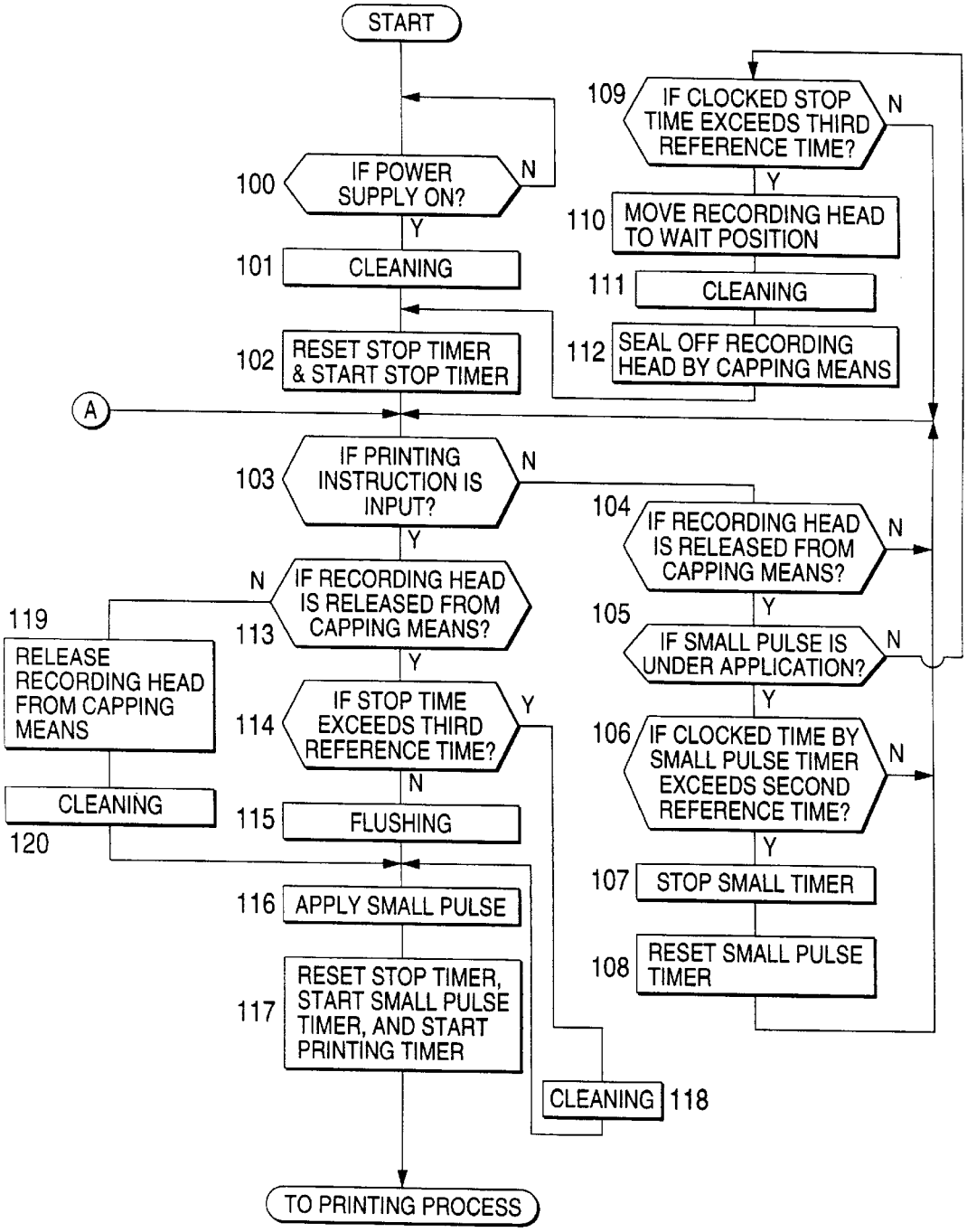
FIG. 7 is a flow chart of part of the operations of the above recording device and, in particular, a clogged-up condition solving operation and a clogging-up preventing operation respectively included in a process which extends from the start of the power supply to the start of the printing operation.

At first, if the box-shaped power supply switch SW is turned on (in FIG. 7, Step 100), then the carriage 1 is moved to its home position and a cleaning operation is executed (in FIG. 7, Step 101).

This cleaning operation is carried out in accordance with the length of the power supply off time T1 clocked by the power supply off timer 38 (see FIG. 3), that is, the length of the time during which the recording device has been stopped. In particular, when the power supply off time T1 is equal to or less than a first reference time Ta, such as 6 hours, the cleaning operation is not carried out; and, when the power supply off time T1 exceeds the first reference time Ta, the cleaning operation is executed in such a manner that the number of times the nozzle plate 10 is rubbed by an elastic plate forming the cleaning means 9, the rubbing force and speed of the nozzle plate 10 by the elastic plate, and the like are adjusted according to the actual power supply off time T1. At a stage where the cleaning operation is ended, the stop time 36 is reset and is started again to thereby clock or count the time of the printing stop condition while the power supply is being put to work (in FIG. 7, Step 102).

In a state in which a printing instruction is not input (in FIG. 7, Step 103) and, at the same time, in a state in which the recording head 6 is not sealed off by the capping device 8 (in FIG. 7, Step 104) and a small pulse is applied and the nozzle opening 11 is thereby prevented from being clogged up (in FIG. 7, Step 105), if a clock time T2 clocked by the small pulse timer 37 exceeds a second reference time Tb such as 20 sec. (in FIG. 7, Step 106), the application of the small pulse is stopped (in FIG. 7, Step 107) and the small pulse timer 37 is reset (in FIG. 7, Step 108), waiting for the input of the printing instruction (in FIG. 7, Step 103). This prevents the ink solvent against volatilization due to the vibrations of the menisci in the neighborhood of the nozzle opening 11, thereby being able to maintain a state in which the clogged-up condition of the nozzle opening 11 can be solved easily by the cleaning means 9.

The second reference time Tb can be changed properly according to the peripheral environment temperature that is detected by temperature detect means 41. That is, if the peripheral environment temperature is higher than the normal temperature, the second reference time Tb is shortened down to 10 sec. or so and, if the former is lower than the latter, then the second reference time Tb is extended up to 40 sec. or so.

Also, when the recording head 6 is not sealed off by the capping device 8 (in FIG. 7, Step 104) and the application of the small pulse initially being executed is interrupted (in FIG. 7, Step 105), it is checked whether the clocked time T3 of the stop timer 36 exceeds a third reference time Tc or not. If it is found that the clocked time exceeds the third reference time Tc (in FIG. 7, Step 109), then the recording head 6 is moved to the wait position (in FIG. 7, Step 110) and the nozzle plate 10 is cleaned by the cleaning means 9, thereby preventing the nozzle opening 11 from being clogged up or solving the clogged-up condition of the nozzle opening 11 (in FIG. 7, Step 111).

The third reference time Tc can be changed properly according to the peripheral environment temperature that is detected by the temperature detect means 41. That is, if the detected peripheral environment temperature is higher than the normal temperature, the third reference time Tc is shortened and, if the former is lower than the latter, then the third reference time Tc is extended.

After completion of the cleaning operation, the recording head 6 is sealed off by the capping device 8 (in FIG. 7, Step 112), the stop timer 36 is reset (in FIG. 7, Step 102), and the input of the printing instruction is waiting for (in FIG. 7, Step 103). Here, when a time T3 clocked by the stop timer 36 does not exceed the third reference time Tc (in FIG. 7, Step 109), the recording device is held in a state in which the clogged-up nozzle opening can be solved by the cleaning operation and, therefore, the control means 30 may wait for the input of a printing instruction as it is (in FIG. 7, Step 103).

In this state, if a printing instruction is input from a host computer (not shown) (in FIG. 7, Step 103), then the control means 30 judges whether the recording head 6 is sealed off by the capping device 8 or not. If it is found that the recording head 6 is released from the capping device 8 or is not sealed off by the capping device 8 (in FIG. 7, Step 113), then the control means 30 judges the stop time in accordance with the clocked time of the stop timer 36. If it is found that the stop time T3 in the above-mentioned released state does not exceed the third reference time (in FIG. 7, Step 114), then the control means 30 applies a drive signal from the drive signal generation circuit 31 to all of the piezo-vibrators 17 to thereby cause all nozzle openings to jet out the predetermined number of ink drops, for example, 200 ink drops per nozzle opening to the ink receive portion such as the capping device 8, thereby executing a flushing operation (in FIG. 7, Step 115). This flushing operation eliminates completely the fear that the nozzle opening can be clogged up, so that the recording device can be moved to the printing process.

The number of ink drops to be jetted out can be set according to the peripheral environment temperature that is detected by the temperature detect means 41. That is, when the detected peripheral environment temperature is higher than the room temperature, the number of ink drops is increased up to a number greater than that at the normal temperature and, on the other hand, when the detected peripheral environment temperature is lower than the room temperature, the number of ink drops is decreased down to a number smaller than that at the normal temperature.

After completion of the flushing operation, the control means 30 applies the above-mentioned small pulse to the respective piezo-vibrators 17 of the recording head 6 (in FIG. 7, Step 116) to cause the menisci of the nozzle openings to vibrate slightly, thereby maintaining the nozzle openings 13 in the printable condition. At the stage when the application of the slight vibrations is ended, the stop timer 36 and small pulse timers 37 are reset and are then started, and further the interrupted condition of the printing timer 35 is removed and the printing timer 35 is started (in FIG. 7, Step 117), so that the recording device is moved to the printing process and the control means 30 waits for the input of the printing data.

On the other hand, when the recording head 6 has been released from the capping device 8 for the third reference time Tc or longer (in FIG. 7, Step 114), the recording head 6 is moved to the wait position and the cleaning operation is executed (in FIG. 7, Step 118). This can surely solve such clogged-up condition that cannot be solved by the flushing operation. At the stage when the cleaning operation is ended, through the flushing operation to be carried out as the need arises, the small pulse is applied to the recording head 6 (in FIG. 7, Step 116) to thereby vibrate the menisci of the nozzle opening 11 slightly. This prevents the nozzle opening, which has recovered its ink drop jet-out ability, from being clogged up and also makes it possible to wait for the input of a printing signal while maintaining the printable condition. At the same time when the menisci are vibrated slightly, this processing jumps over to the step (117) of FIG. 7 and waits for the input of the print data.

On the other hand, at the time when the printing instruction is input (in FIG. 7, Step 103), when the recording head 6 is sealed off by the capping device 8 (in FIG. 7, Step 113), the recording head 6 is removed from the capping device 8 to thereby open the recording head 6 into the printable condition (in FIG. 7, Step 119), a similar cleaning operation to be above-mentioned case is carried out (in FIG. 7, Step 120), the small pulse is applied to the piezo-vibrator 17 of the recording head 6 (in FIG. 7, Step 116) to vibrate the menisci of the nozzle opening 11 slightly, thereby extending the time necessary to reach the clogged-up condition of the nozzle opening. Thereafter, the stop timer 36 and small pulse timer 37 are reset in accordance with the application of the small pulse and are then started, and further the interruption of the printing timer 35 is removed and the printing timer 35 is then started (in FIG. 7, Step 117), waiting for the input of the printing data.

Figure 8:
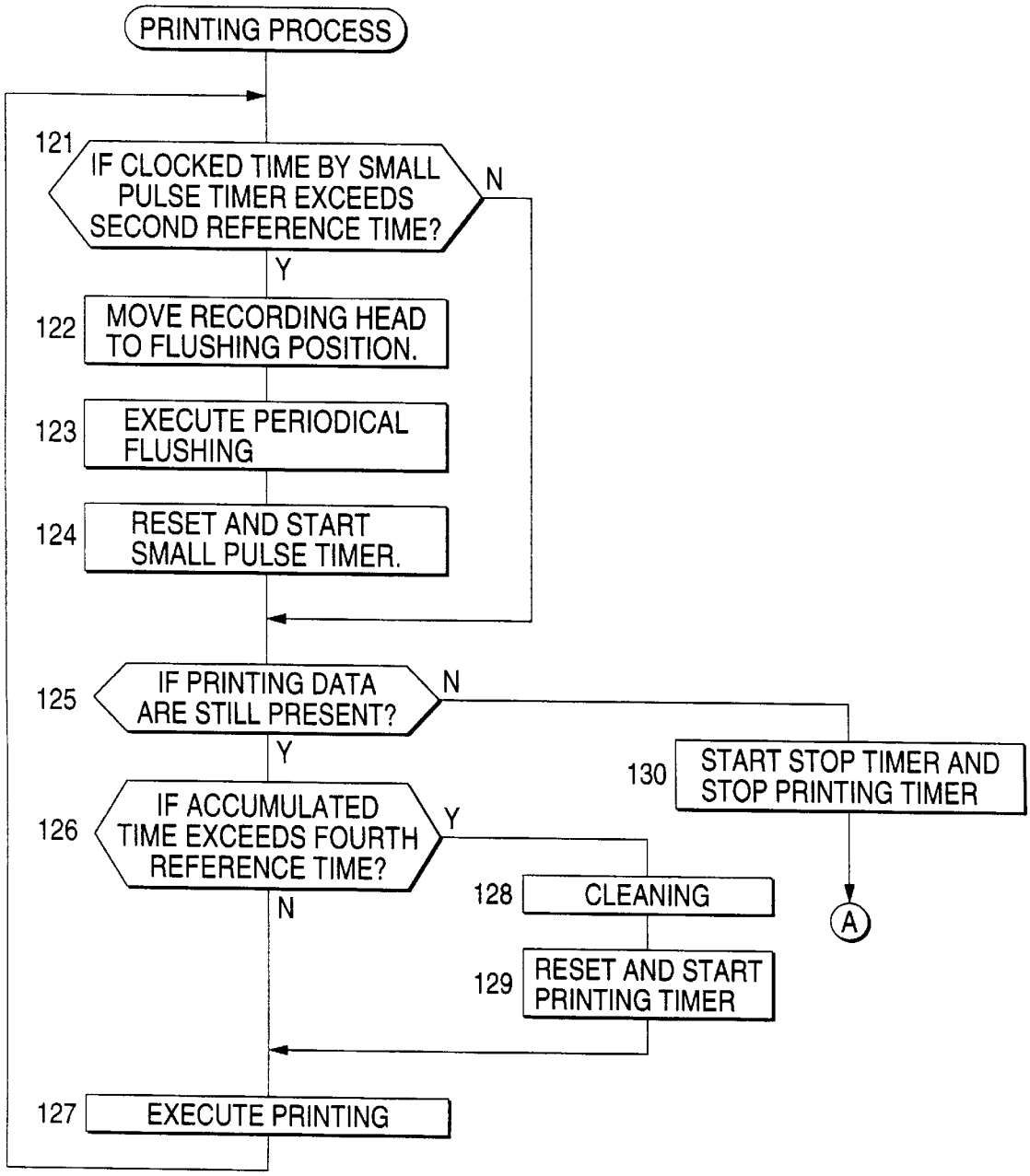
FIG. 8 is a flow chart of part of the printing process of the above recording device, mainly the clogging-up preventing operation thereof.

When the printing preparation is made in accordance with a printing instruction and the printing data are input, the control means 30 executes a series of printing operations base on the printing data input (in FIG. 8, Step 127) until the small pulse timer 36 clocks the second reference time Tb (in FIG. 8, Step 121).

If the time clocked by the small pulse timer 36 during the printing operation reaches the second reference time Tb (in FIG. 8, Step 121), then the control means 30 moves the carriage 1 out of the printing area according which mover the recording head 6 toward the flushing position, for example, toward the capping device 8 side during the printing process to thereby cause the recording head 6 to be disposed opposedly to the capping device 8 (in FIG. 8, Step 122), where a given number of ink drops corresponding to, for example, 60 dots, are jetted out to thereby carry out a periodical flushing operation (in FIG. 8, Step 123). At the time when the flushing operation is ended, the small pulse timer 37 is reset to thereby cause the small pulse timer 37 to resume its time clocking operation (in FIG. 8, Step 124).

When the print data are still present and the printing operation is executed continuously after the completion of the flushing operation (in FIG. 8, Step 125), if the accumulated time T4 of a series of printing operations clocked by the printing timer 35 is equal to or less than a fourth reference time Td such as 2 hours (in FIG. 8, Step 126), then, without carrying out the cleaning operation, a flushing operation is executed and the menisci of the nozzle openings are vibrated slightly to thereby prevent the nozzle openings 13 from being clogged up and the printing data is printed (in FIG. 8, Step 127).

The fourth reference time Td may be shortened when the peripheral environment temperature that is detected by the temperature detect means 41 is higher than the room temperature, or may be extended when the detected temperature is lower than the room temperature.

When the series of printing operations become longer and thus the accumulated time T4 of the printing timer 37 exceeds the fourth reference time Td (in FIG. 8, Step 126), the control means 30 interrupts the printing operation forcibly and moves the recording head 6 to the cleaning means 9, where the nozzle plate 10 is cleaned (in FIG. 8, Step 128). After completion of the cleaning operation, the printing timer 35 is reset and is then started again (in FIG. 8, Step 129).

If the printing of all of the print data is completed (in FIG. 8, Step 125), then the control means 30 starts the time clocking operation of the stop timer 36, stops the time clocking operation of the printing timer 35 (in FIG. 8, Step 130), and jumps over to the step (103) of FIG. 7. At the time of completion of all of the print data (in FIG. 8, Step 125), regardless of the print data, the small pulse is applied to the recording head 6 to vibrate the menisci of the nozzle opening 11 slightly to thereby extend the time necessary for the nozzle opening 13 to be clogged up, while maintaining a state in which, when the print data are input again within a short time, the thus input print data can be printed immediately.

While the control means 30 is vibrating the menisci of the nozzle opening 11 slightly and is waiting for the input of a print instruction, if the print instruction is not input (in FIG. 7, Step 103), the recording head 6 is not yet sealed off by the capping device 8 (in FIG. 7, Step 104), and the continuous time of the slight vibrations due to the application of the small pulse (in FIG. 7, Step 105) reaches the second reference time Tb (in FIG. 7, Step 106), then the control means 30 stops the application of the small pulse (in FIG. 7, Step 107), resets the small pulse timer 37 (in FIG. 7, Step 108), and waits continuously for the input of a printing instruction (in FIG. 7, Step 103).

This prevents the ink solvent from being volatilized due to the unnecessary slight vibrations of the menisci during the long waiting time after completion of the printing operation, so that the nozzle opening can be maintained in an ink jettable condition by means of the flushing and cleaning operations.

In the waiting state, if the power supply switch SW is operated and cut-off of the power is thereby instructed (in FIG. 9, Step 131), then the control means 30 detects whether the recording head 6 is still released from the capping device 8 or not. That is, if it is found that the recording head 6 is not sealed off by the capping device 8 (in FIG. 9, Step 132), then the recording head 6 is cleaned by the cleaning device 9 (in FIG. 9, Step 133) and then, the recording head 6 is sealed off by the capping device 8 (in FIG. 9, Step 134), thereby holding the recording head 6 in a state in which, when the power supply is put to work next, it is able to perform a printing operation at once.

Figure 9:
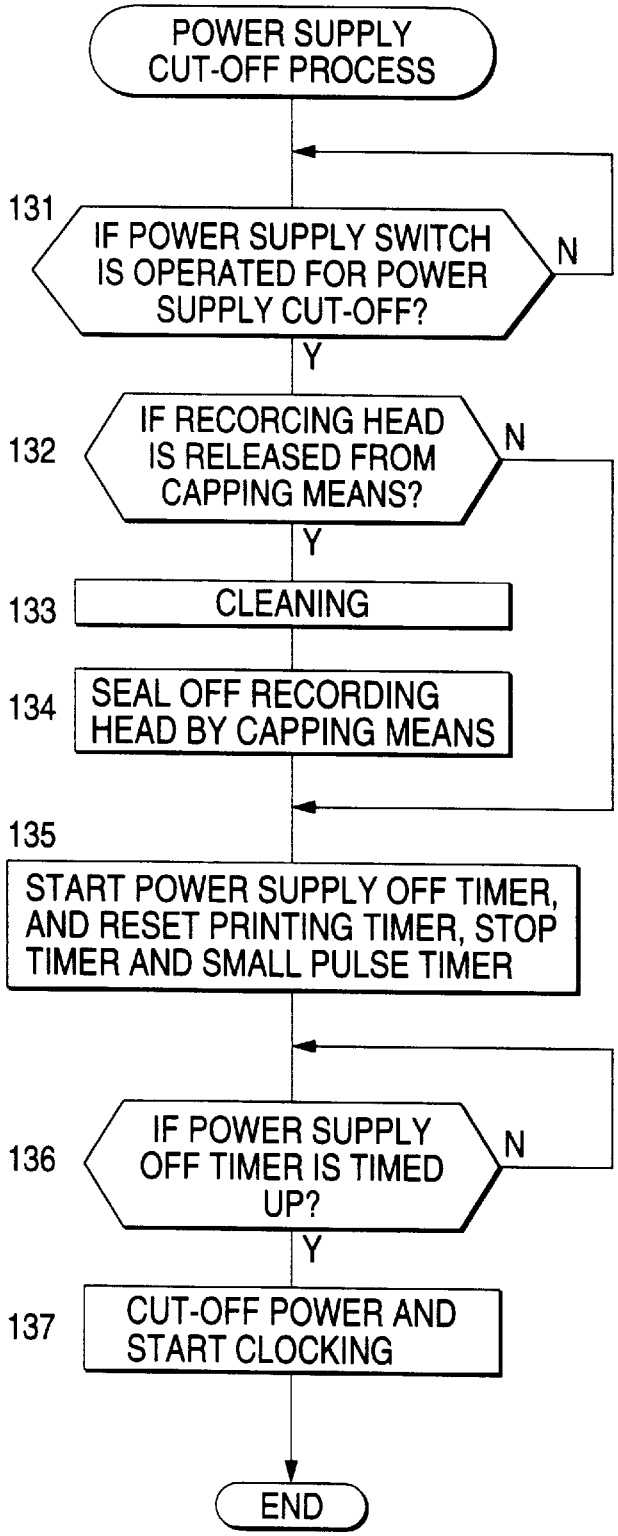
FIG. 9 is a flow chart of an power cut-off step included in the operations of the above recording device.

At the stage where it is confirmed that the recording head 6 is sealed off by the capping device 8 in this manner, the control means 30 starts the power supply off timer 38 and also resets the printing timer 35, stop timer 36 and small pulse timer 37 respectively (in FIG. 9, Step 135). And, if the power supply off timer 38 is timed up (in FIG. 9, Step 136), then the relay 40 is de-energized to thereby cut off the supply of the power to the whole recording device, and the time clocking is started again to clock the time during which the recording device is left in the power supply off condition (in FIG. 9, Step 137).

In the above-mentioned embodiment, the time during which the power is not supplied to the recording device is clocked by the power supply off timer which is used to carry out a delay operation for power cut-off. However, this is not required. For example, even if there is provided a special timer which is used exclusively to clock the time of the power supply off condition, it is clear that a similar operation can also be achieved.

Also, in the above-mentioned embodiment, description has been given of the recording head of an ink jet type which uses a piezo-vibrator having a vertical vibration mode as the pressure generation means thereof. However, the invention is not limited to this but, clearly, the invention can also be applied to a recording head using a piezo-vibration-plate which is formed in a plate shape or a film shape and can be flexibly vibrated, or a recording head using a heat generation element which generates Joule heat within a pressure generation chamber to vaporize ink to thereby generate pressure.

POSSIBILITY OF THE INDUSTRIAL USE

For example, ink, which contains the following components, blurs little and can form minute dots on the recording medium: 2 wt % of pigment, 15 wt % of resin, 3 wt % of di-ethylene glycol, 10 wt % of thickening agent, 1 wt % of surface active agent, and 69 wt % of water, can be used in the present invention.

The inventors studied the time necessary for the nozzle opening to be clogged up using the above ink. Our study shows that, unless there was carried out a flushing operation in which 300 pcs. of ink drops per nozzle opening are jetted out from the nozzle opening every 10 seconds under the low temperature environment, every 5 seconds in the normal temperature, and every second in the high temperature environment, the first-time ink drops could not be jetted out in synchronization with the printing data or there occurred the poor jetting-out of the ink drops. When the flushing operation was not executed for 30 minutes, the jet-out ability of the nozzle opening could not be recovered only by executing the flushing operation if a cleaning operation was not carried out.

On the other hand, when the above-mentioned printing method according to the invention was applied to the recording device using the same ink, since the menisci were vibrated slightly, the time necessary for the first-time ink drops to be unjettable could be extended up to 300 seconds in the low temperature environment, 240 seconds in the normal temperature environment, and 120 seconds in the high temperature environment.

Also, when a continuous printing operation was carried out while performing the flushing operation every 120 seconds under the high temperature environment, at the time of the passage of about 1 hour, it was found that the ink amounts of the ink drops jetted out were reduced; but, when a continuous printing operation was carried out again while performing the flushing operation every 60 seconds, the poor jetting-out of the ink drops did not occur before the passage of 2 hours. In the light of this test as well, it is clear that a printing method according to the invention not only can prevent the reduction of the printing speed as much as possible but also can extend effectively the time for the nozzle opening to be clogged up.

As has been described heretofore, according to the invention, the cycle of the jetting-out of the ink drops to be executed out of the printing area for recovery of the ink jet-out ability of the nozzle opening can be extended as much as possible to thereby reduce the number of times the printing operation is interrupted, which in turn can improve the printing speed as well as can prevent the waste of ink.

Also, during the printing period, when the ink drops are not jetted out for one or more cycles, the small pulse is applied to thereby be able to vibrate slightly the menisci of the nozzle opening, which in turn makes it possible to prevent the nozzle opening from being clogged up without producing any ink mist. At the same time, when the printing operation is interrupted and the application of the small pulse continues for a given time or longer, then the application of the small pulse may be stopped. That is, even when there is used such ink that is easy to form a membrane or increase the viscosity thereof, the nozzle opening can be prevented against such clogged-up condition that can result in the unrecoverable ink drop jet-out condition, without the capping means executing the seal-off operation. Due to this, the sealing operation of the recording head by the capping means, which requires time for installation and removal thereof, can be reduced as much as possible, so that the printing speed of the recording device can be improved.

What is claimed is:

1. A printing method for use in a recording device of an ink jet type which includes a recording head of an ink jet type including a nozzle opening for jetting out ink drops for forming dots on a recording medium, a pressure generation chamber formed in communication with the nozzle opening, pressure generation means for applying pressure to the pressure generation chamber, and drive signal generation means for supplying to the pressure generation means a drive signal for changing the pressure of the pressure generation chamber; comprising the step of:

supplying a small pulse to the pressure generation means in accordance with a timing signal for printing so as to vibrate menisci formed in the nozzle opening such that the ink drops cannot be jetted out, wherein said supplying step is triggered by a printing instruction signal.

2. The printing method according to claim 1, wherein, while the recording head of an ink jet type is situated in a terminal end portion of a printing area and a carriage for moving the recording head of an ink jet type reciprocally in a width direction of the recording medium is stopping a printing operation for change of direction, only the small pulse is applied to the recording head of an ink jet type.

3. The printing method according to claim 1, wherein, when the time for application of the small pulse exceeds a second reference time which is set equal to or shorter than the time necessary for the nozzle opening to be clogged up even when the menisci are vibrated slightly due to the application of the small pulse, the drive signal enabling the nozzle opening to jet out ink drops is applied to thereby execute a flushing operation for jetting out a given number of ink drops.

4. The printing method according to claim 3, wherein the given number of ink drops can be changed in accordance with a peripheral environment temperature.

5. The printing method according to claim 1, wherein, during the second reference time extending from the time of completion of a printing operation to the time when the jetting-out of the ink drops from the nozzle opening becomes impossible, the small pulse is applied to thereby cause the menisci to vibrate slightly, and at the time when the second reference time has passed, the application of the small pulse is stopped.

6. The printing method according to claim 5, wherein, at the time when a printing signal is input again after the stop of application of the small pulse, a drive signal enabling the ink drops to be jetted out is applied to the nozzle opening and a given number of ink drops are jetted out from the nozzle opening, before a printing operation is carried out.

7. The printing method according to claim 5, wherein the second reference time can be changed in accordance with a peripheral environment temperature.

8. The printing method according to claim 1, wherein, at the time when a third reference time permitting the jetting-out of ink drops for the next printing has passed after the time of completion of a printing operation, the recording head of an ink jet type is moved to a cleaning unit disposed out of a printing area and is then cleaned by the cleaning unit.

9. The printing method according to claim 8, wherein the third reference time can be changed in accordance with a peripheral environment temperature.

10. The printing method according to claim 1, wherein, at the time when an accumulated time of the printing operation exceeds a fourth reference time, the printing operation is interrupted, and the recording head of an ink jet type is moved to a cleaning unit disposed out of a printing area and is then cleaned by the cleaning unit.

11. The printing method according to claim 10, wherein the fourth reference time can be changed in accordance with a peripheral environment temperature.

12. A recording device of an ink jet type comprising:

a recording head of an ink jet type including a nozzle opening for jetting out ink drops for forming dots on a recording medium, a pressure generation chamber formed in communication with the nozzle opening;

pressure generation means for applying pressure to the pressure generation chamber;

drive signal generation means for supplying a drive signal to the pressure generation means for changing the pressure of the pressure generation chamber; and control means, in accordance with a print timing signal, for supplying a small pulse to the pressure generation means to cause menisci formed in the nozzle opening to vibrate to such a degree that ink drops cannot be jetted out from the nozzle opening, wherein said small pulse is applied in response to a printing instruction signal.

13. The recording device of an ink jet type according to claim 12, wherein, while the recording head of an ink jet type is situated in a terminal end portion of a printing area and a carriage for moving the recording head of an ink jet type reciprocally in a width direction of a recording medium is stopping a printing operation for change of direction, the control means applies only the small pulse to the recording head of an ink jet type.

14. The recording device of an ink jet type according to claim 12, wherein, when the time for application of the small pulse exceeds a second reference time which is set equal to or shorter than the time necessary for the nozzle opening to be clogged up even when the menisci is vibrated slightly due to the application of the small pulse, the control means applies to the nozzle opening the drive signal enabling the nozzle opening to jet out ink drops to thereby execute a flushing operation for jetting out a given number of ink drops.

15. The recording device of an ink jet type according to claim 14, wherein the control means can change the given number in accordance with a peripheral environment temperature that is detected by temperature detect means.

16. The recording device of an ink jet type according to claim 12, wherein, during the second reference time extending from the time of completion of a printing operation to the time when the jetting-out of the ink drops from the nozzle opening becomes impossible, the control means applies the small pulse to thereby cause the menisci to vibrate slightly, and at the time when the second reference time has passed, the control means stops the application of the small pulse.

17. The recording device of an ink jet type according to claim 16, wherein, at the time when a printing signal is input again after the stop of supply of the small pulse, a drive signal enabling the ink drops to be jetted out from the nozzle opening is applied to the nozzle opening to thereby jet out a given number of ink drops, and a printing operation is executed after jetting-out of the given number of ink drops.

18. The recording device of an ink jet type according to claim 16, wherein the control means can change the second reference time in accordance with a peripheral environment temperature that is detected by temperature detect means.

19. The recording device of an ink jet type according to claim 12, wherein, at the time when a third reference time allowing ink drops for the next printing to be jetted out has passed since an end of a printing operation, the control means moves the recording head of an ink jet type to a cleaning unit and then causes the cleaning unit to clean the recording head.

20. The recording device of an ink jet type according to claim 19, wherein the control means can change the third reference time in accordance with a peripheral environment temperature that is detected by temperature detect means.

21. The recording device of an ink jet type according to claim 12, wherein, at the time when the accumulated time of a printing operation exceeds a fourth reference time, the control means interrupts the printing operation and moves the recording head of an ink jet type to a cleaning unit, and then causes the cleaning unit to clean the recording head.

22. The recording device of an ink jet type according to claim 21, wherein the control means can change the fourth reference time in accordance with a peripheral environment temperature that is detected by temperature detect means.

23. A printing method for use in a recording device of an ink jet type which includes a recording head of an ink jet type including a nozzle opening for jetting out ink drops for forming dots on a recording medium, a pressure generation chamber formed in communication with the nozzle opening, and pressure generation means for applying pressure to the pressure generation chamber and, drive voltage generation circuit for generating a first drive voltage having a trapezoidal wave form in synchronization with a timing signal, comprising the steps of:

outputting a first drive voltage to a piezo-vibrator in accordance with a printing signal; and selectively applying a second drive voltage for generation of a small pulse that cannot jet out ink drops from the nozzle opening to a piezo-vibrator in which a non-printing condition has continued for one or more cycles in synchronization with the timing signal.

24. The printing method according to claim 23, wherein the supply of the small pulse is stopped when the time of supply of the small pulse exceeds a given time after completion of a printing operation.

25. The printing method according to claim 23, wherein the small pulse is applied in accordance with an inverted data of print data being currently printed and print data to be printed at the next print timing.

26. The printing method according to claim 23, wherein, at the time when a printing instruction is input from outside, if the recording head of an ink jet type has been released from capping means for the third reference time or longer without executing a printing operation, then, after execution of a flushing operation, the small pulse is applied.

27. A recording device of an ink jet type comprising:

a recording head of an ink jet type including an nozzle opening for jetting out ink drops for forming dots on a recording medium;

a pressure generation chamber formed in communication with the nozzle opening;

pressure generation means for applying pressure to the pressure generation chamber;

a drive voltage generation circuit for generating a first drive voltage having a trapezoidal wave form in synchronization with a timing signal for generating a print pulse;

a drive circuit, in accordance with a printing signal, for outputting the first drive voltage to a piezo-vibrator which is in a printing condition in a next cycle and, in synchronization with the timing signal, for selectively outputting a second drive voltage, which is used to generate a small pulse that cannot jet out ink drops from the nozzle opening to a piezo-vibrator in which a non-printing condition has continued for one or more cycles; and control means for stopping the application of the small pulse when the time of application of the small pulse after completion of a printing operation exceeds a given time.

28. The recording device of an ink jet type according to claim 27, wherein the drive circuit applies the small pulse to the piezo-vibrator in accordance with the an inverted data of the print data being currently printed and print data to be printed at the next print timing.

29. The recording device of an ink jet type according to claim 27, wherein, at the time when a printing instruction is input from outside, if the recording head of an ink jet type has been released from capping means for a third reference time or longer without executing a printing operation, the control means applies to the nozzle opening a drive signal enabling ink drops to be jetted out from the nozzle opening, thereby executing a flushing operation to jet out a given number of ink drops and, after the flushing operation, applies the small pulse and waits for an input of a printing signal.

30. A printing method for use in a recording device of an ink jet type which includes a recording head of an ink jet type including a nozzle opening for jetting out ink drops for forming dots on a recording medium, a pressure generation chamber formed in communication with the nozzle opening, pressure generator which applies pressure to the pressure generation chamber, and drive signal generator which supplies to the pressure generator a drive signal for changing the pressure of the pressure generation chamber; comprising the step of:

supplying a small pulse to the pressure generator in accordance with a timing signal for printing so as to vibrate menisci formed in the nozzle opening such that the ink drops cannot be jetted out when a non-printing condition has continued in said pressure generator for one or more cycles.

31. A recording device of an ink jet type comprising:

a recording head of an ink jet type including a nozzle opening for jetting out ink drops for forming dots on a recording medium, a pressure generation chamber formed in communication with the nozzle opening;

pressure generator which applies pressure to the pressure generation chamber;

drive signal generator which supplies to the pressure generator a drive signal for changing the pressure of the pressure generation chamber; and controller, in accordance with a print timing signal, which supplies to the pressure generator a small pulse to cause menisci formed in the nozzle opening to vibrate to such a degree that ink drops cannot be jetted out from the nozzle opening when a non-printing condition has continued for one or more cycles in said pressure generator.

32. A recording device of an ink jet type comprising:

a recording head of an ink jet type including an nozzle opening for jetting out ink drops for forming dots on a recording medium;

a pressure generation chamber formed in communication with the nozzle opening;

pressure generator which applies pressure to the pressure generation chamber;

a drive voltage generation circuit for generating a first drive voltage having a trapezoidal wave form in synchronization with a timing signal provided from outside;

a drive circuit, in accordance with a printing signal provided from outside, for outputting the first drive voltage to a piezo-vibrator and, in synchronization with the timing signal, for selectively outputting a second drive voltage, which is used to generate such a small pulse that cannot jet out ink drops from the nozzle opening, to the piezo-vibrator in which a non-printing condition has continued for one or more cycles; and controller which stops the application of the small pulse when the time of application of the small pulse after completion of a printing operation exceeds a given time.

33. A printing method for use in a recording device of an ink jet type which includes a recording head having nozzle openings for jetting out ink drops for forming dots on a recording medium, a pressure generation chamber formed in communication with the nozzle opening, and pressure generation means for applying pressure to the pressure generation chamber, and a drive voltage generation circuit for generating a first drive voltage having a trapezoidal wave form in synchronization with a timing signal, comprising the steps of:

outputting a first drive voltage to a piezo-vibrator in accordance with a printing signal; and selectively applying a second drive voltage for generation of a small pulse that cannot jet out ink drops from the nozzle opening to a piezo-vibrator, wherein the second drive voltage is applied based upon print data being currently printed and print data to be printed in a next cycle.

34. A recording device of an ink jet type comprising:

a recording head of an ink jet type including an nozzle opening for jetting out ink drops for forming dots on a recording medium;

a pressure generation chamber formed in communication with the nozzle opening;

pressure generation means for applying pressure to the pressure generation chamber;

a drive voltage generation circuit for generating a first drive voltage having a trapezoidal wave form in synchronization with a timing signal for generating a print pulse; and a drive circuit, in accordance with a printing signal, for outputting the first drive voltage to a piezo-vibrator which is in a printing condition in a next cycle and, in synchronization with the timing signal, for selectively outputting a second drive voltage, which is used to generate a small pulse that cannot jet out ink drops from the nozzle opening, wherein the second drive voltage is applied based upon print data being currently printed and print data to be printed in a next print cycle.

35. The printing method according to claim 33, wherein the small pulse is applied in accordance with an inverted data of print data being currently printed and print data to be printed in a next print cycle.

36. The recording device according to claim 34, wherein the drive circuit applies the small pulse in accordance with an inverted data of print data being currently printed and print data to be printed a in a next print cycle.

* * * * *

UNITED STATES PATENT AND TRADEMARK OFFICE

CERTIFICATE OF CORRECTION

PATENT NO.: 6,070,959
DATED: June 6, 2000
INVENTOR(S): Kenichi Kanbayashi , KUMAGAI, TOSHIO, KOSUGI, YASUHIKO It is certified that error appears in the above-identified patent and that said Letters Patent is hereby corrected as shown below:

[30] Foreign Application Priority Data

| | | | |
|---|---|---|---|
| July 20, 1995 | [JP] | Japan | 7-206662 |
| November 20, 1995 | [JP] | Japan | 7-301723 |

Signed and Sealed this

First Day of May, 2001

*Attest:*

Nicholas P. Godici

NICHOLAS P. GODICI

*Attesting Officer*

*Acting Director of the United States Patent and Trademark Office*